United States Patent [19]

Lundberg

[11] Patent Number: 4,721,211

[45] Date of Patent: Jan. 26, 1988

[54] HANGING ARRANGEMENT FOR HOLDING SHEET-LIKE ARTICLES

[75] Inventor: Tommie Lundberg, Vikingstad, Sweden

[73] Assignee: LICA Lundberg International Center AB, Stockholm, Sweden

[21] Appl. No.: 741,094

[22] Filed: Jun. 4, 1985

[30] Foreign Application Priority Data

Jun. 8, 1984 [SE] Sweden ..... 8403116

[51] Int. Cl.[4] ..... A47F 7/16

[52] U.S. Cl. ..... 211/46; 211/116; 211/162; 312/184

[58] Field of Search ..... 211/46, 45, 113, 116, 211/94, 162; 312/184, 183; 24/67.7, 513, 515, 517, 499, 500, 67.3

[56] References Cited

U.S. PATENT DOCUMENTS

| | | | |
|---|---|---|---|
| 546,492 | 9/1895 | Millert | 24/67.7 |
| 955,325 | 4/1910 | Dawson | 24/67.7 |
| 1,382,780 | 6/1921 | Gurske | 24/67.11 |
| 2,252,402 | 8/1941 | Kern | 312/184 X |

FOREIGN PATENT DOCUMENTS

| | | | |
|---|---|---|---|
| 1207336 | 12/1965 | Fed. Rep. of Germany | 312/184 |
| 752881 | 10/1933 | France | 312/184 |
| 772077 | 10/1934 | France | 312/184 |
| 1191584 | 10/1959 | France | 312/184 |
| 281150 | 2/1952 | Switzerland | 312/184 |
| 338427 | 7/1959 | Switzerland | 211/46 |
| 9753 | of 1892 | United Kingdom | 24/67.7 |

*Primary Examiner*—Ramon S. Britts
*Assistant Examiner*—Blair M. Johnson
*Attorney, Agent, or Firm*—Sughrue, Mion, Zinn, Macpeak and Seas

[57] ABSTRACT

In a hanging arrangement for holders intended for holding sheet-like articles (6) the holder (1) comprises two pivotable parts (2,3) which embrace the upper edge of respective suspended articles. The shaft (4) about which the holder parts pivot is bent to form an inner hook member (4*a*) and an outer hook member (4*b*), which extend in different planes. A hanging frame (10) comprises two mutually parallel U-shaped sections having wires or rods (13) extending therebetween. The inner hook member (4*a*) of the holder (1) is intended to be placed on a wire (13), therewith enabling the holder to be moved inwardly. The outer hook member (4*b*) is then attached to the outer U-shaped section (12), to complete the operation.

6 Claims, 2 Drawing Figures

HANGING ARRANGEMENT FOR HOLDING SHEET-LIKE ARTICLES

FIELD OF INVENTION

The present invention relates to a holding arrangement for holders intended for holding sheet-like articles, such as drawings, charts, and the like, said holders comprising two parts which can be swung about an axis and which embrace the upper edge of the respective suspended articles and are pressed towards one another by means of one or more spring means, and said hanging arrangement comprising a frame structure having horizontally extending inner and outer mutually parallel frame parts and transversely extending wires or rods mounted therein.

BACKGROUND ART

In certain types of known hanging arrangements, the holders are provided at one end thereof with a sleeve-like element arranged to co-act with a post of a hanging frame. The holders, suspended at one end, have therewith been pivotable in the horizontal plane.

In many cases, however, difficulties are experienced in lifting a sheet-like article provided with a holder into position and simultaneously fitting the sleeve-like element onto the post. This difficulty becomes particularly acute when the holder carries a large number of sheet-like articles of large surface area, therewith exhibiting considerable weight.

OBJECT OF THE INVENTION

One object of the present invention is to provide a hanging arrangement of the aforesaid kind which will enable sheet-like articles held by the holders to be located in a storage position adjacent one another in a safe and reliable fashion, and which greatly facilitates handling of the articles, both when placing the articles in their storage position and when withdrawing the articles therefrom.

Another object of the invention is to provide a hanging arrangement of the aforesaid kind which can be readily manufactured and readily placed in a desired position.

SUMMARY OF THE INVENTION

A hanging arrangement according to the invention which fulfils these and other objects is mainly characterized in that the holder is provided at one end thereof with a first hook member which is intended to be hung upon and moved along a transverse wire or rod, and is provided at the other end thereof with a second hook member which is intended to be hung on the outer frame part.

When the first hook member is hung on the wire or rod, a large part of the weight of the sheet-like object is relieved. It is then a simple matter to push the holder, together with the article held thereby, inwardly on the wire or rod, with the holder sloping downwardly, i.e. at an angle to the horizontal plane, and then to attach the outer, second hook member onto a corresponding frame part when said holder reaches its terminal position, therewith to complete the hanging operation.

The holders together with the sheet-like articles held thereby can also be readily removed from the hanging arrangement in an equally simple manner, since the major part of the weight of the sheet-like articles is, in this case, taken up by the rod or the wire.

In practice the hook members preferably move along planes which extend at right angles to one another. The inner hook member thus suitably extends in a plane which is parallel with the longitudinal axis of the frame elements, while the outer hook member moves in a plane at right angles hereto.

In addition hereto, the uppermost point of the outer hook member in the hanging position is located at a higher level than the uppermost point on the inner hook member.

An important feature of the preferred embodiment of the invention is thus that the two hook members have mutually different shape and direction, which imparts an asymmetric design to the holder as a whole.

The manufacture and attachment of the hook members is greatly facilitated when, in accordance with one preferred embodiment, said members comprise bent end parts of the pivot shaft of the pivotal holder parts.

The frame structure preferably comprises U-shaped sections, preferably having upper mutually parallel and oppositely directed section parts.

An embodiment of the invention will now be described in more detail with reference to the accompanying drawings.

DESCRIPTION OF A PREFERRED EMBODIMENT

Figure 1:
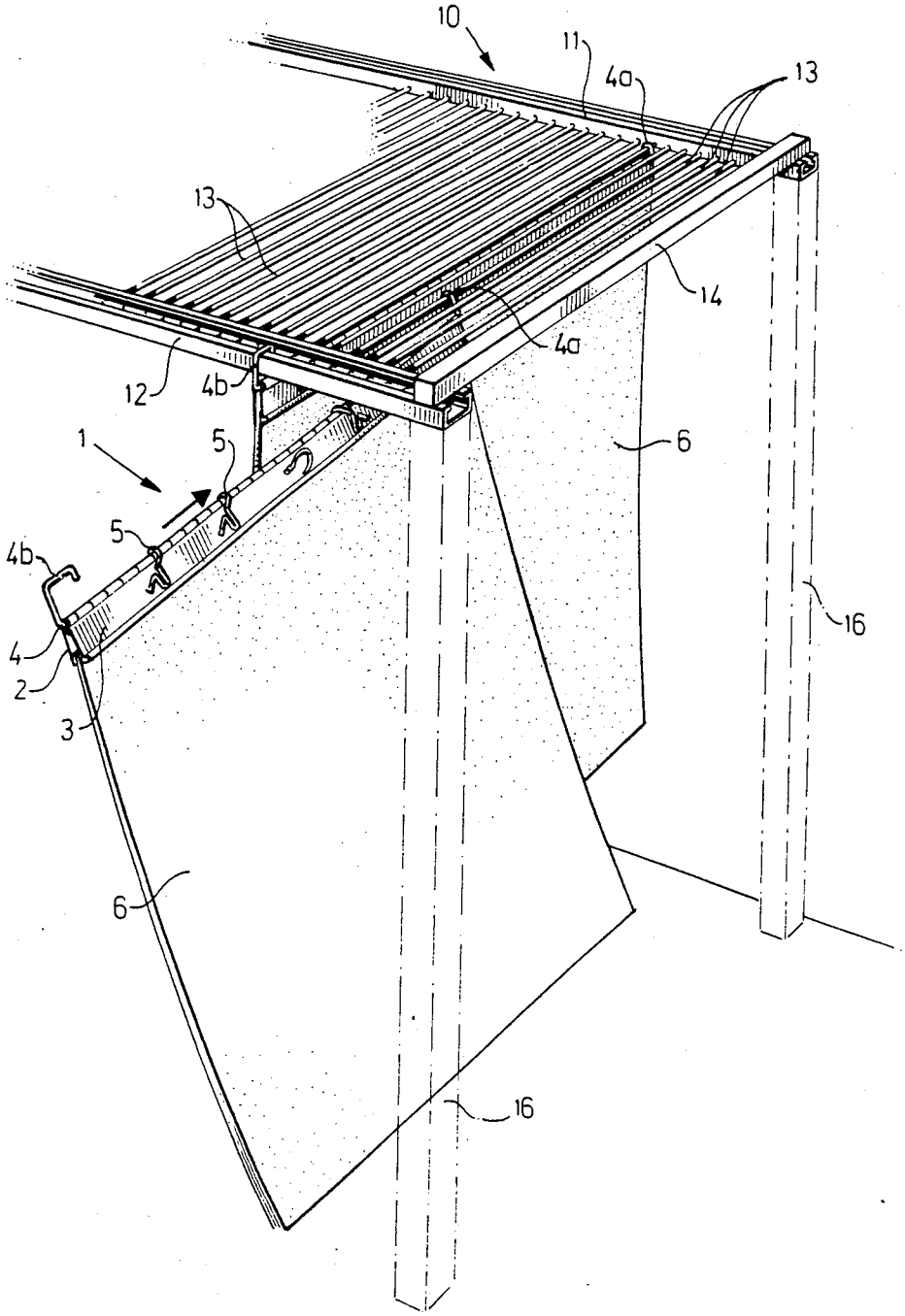
FIG. 1 is a perspective view of a hanging arrangement according to the invention, and shows hung sheet-like articles being moved to a storage position.

A holder 1 intended for holding sheet-like articles 6, such as drawings or charts, comprises two parts 2,3 which can be pivoted about a shaft 4, and which are adapted to embrace the upper edge of the suspended articles 6. The two parts 2,3 are pressed towards one another by means of a number of spring clips 5.

The pivot shaft 4 is extended at both ends thereof, these extensions being bent into the shape of hook members, namely an inner hook member **4*a*, which is arranged to move or run in a plane extending at right angles to the longitudinal axis of the holder, and an outer hook member 4*b*** which is intended to move or run in the plane of the holder.

The hanging arrangement also comprises a frame structure 10 having inner and outer parallel frame parts in the form of U-shaped sections 11,12 with upper, counter-directional horizontal profiled sections. Extending between the aforesaid frame parts are horizontal rods or wires 13, which pass through the one leg of the U-shaped sections and are attached to said sections by means of weld joints 15.

The rods or wires 13 may be provided with an outer slip or slide coating, for example a coating of plastics material.

Figure 2:
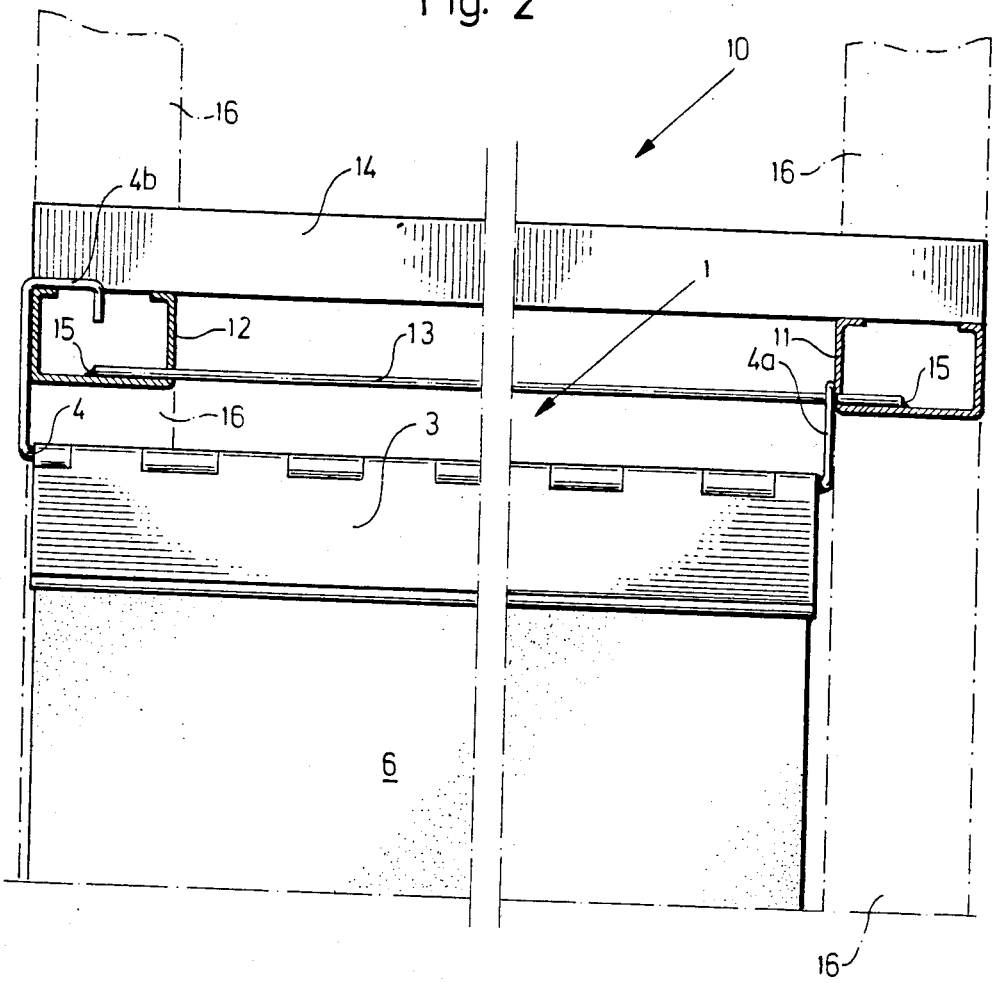
FIG. 2 is a front view of the hanging arrangement illustrated in FIG. 1, and shows the holder in the storage position.

The frame structure further comprises a forwardly located cross member 14 and supporting struts 16, which are suitably vertical and which are shown in chain lines in FIG. 1. In the illustration of FIG. 2 two further upstanding support struts 16 are shown, also in chain lines. The intention herewith is to indicate that the frame structure can be extended vertically with an additional, corresponding hanging arrangement.

With the holders in their hanging position, the uppermost point of the outer hook member 4b of the holder 1 is located on a higher level than the uppermost point of the inner hook member 4a. As will be seen from FIG. 2, the intention herewith is to enable the outer hook member 4b to co-act with the outer frame section 12 while the inner hook member 4a rests upon and is displaceable along the rod or wire 13.

When a holder 1 to which a sheet-like article 6 has been attached shall be hung on the frame structure, the inner hook member 4a is first attached to a rod or wire 13, which will therewith support most of the weight of the article 6. The holder is then pushed inwardly along the rod or wire 13 and the outer hook member 4b is hooked onto the outer U-shaped frame section 12, therewith to complete the operation.

The wire or rod 13 is also used to support the weight of the sheet-like article when removing a holder from the frame.

What is claimed is:

1. The combination of (1) a hanging arrangement for holders for holding sheet-like articles, such as drawings, charts and the like and (2) said holders, each holder comprising two parts which are swingable about a horizontal pivot shaft, which are adapted to embrace the upper edge of a respective vertically suspended article and which are pressed towards one another by means of one or more spring means, said hanging arrangement comprising a frame structure having horizontally extending inner and outer mutually parallel frame parts which are perpendicular to said pivot shaft, and a plurality of spaced, parallel hanger rods extending transversely therebetween and parallel to said pivot shaft, the ends of each hanger rod being fixedly attached to a respective frame part, wherein the holder has at one end thereof an inner hook member means hanging upon, and a respective hanger rod, and at the other end thereof has an outer hook member means hanging on the outer frame part, whereby the outer hook member means may be disengaged from the outer frame part so that the inner hook member means may be slidably displaced along the hanger rod to allow access to said suspended article, the outer hook member means, when hanging on the outer frame part, being displaceable along and parallel to, the outer frame part.

2. A hanging arrangement according to claim 1, wherein the uppermost point of the outer hook member means in its hanging position is located at a higher level than the uppermost point on the inner hook member means.

3. A hanging arrangement according to claim 1, wherein the hook member means comprise bent end parts of the pivot shaft.

4. A hanging arrangement according to claim 1, wherein the frame parts comprise U-shaped sections, each having oppositely inwardly directed and mutually parallel upper section parts.

5. A hanging arrangement according to claim 1 wherein said inner hook member means has a bent hook portion extending in a plane perpendicular to said pivot shaft, and wherein said outer hook member means has a bent hook portion extending in a plane parallel to said pivot shaft.

6. The combination according to claim 5, wherein said inner and outer frame parts are disposed in the same horizontal plane.

* * * * *